US006385578B1

(12) United States Patent
Lee et al.

(10) Patent No.: US 6,385,578 B1
(45) Date of Patent: May 7, 2002

(54) METHOD FOR ELIMINATING ANNOYING NOISES OF ENHANCED VARIABLE RATE CODEC (EVRC) DURING ERROR PACKET PROCESSING

(75) Inventors: Sang-Min Lee; Young-Jin Kim, both of Yongin-shi (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/413,767

(22) Filed: Oct. 7, 1999

(30) Foreign Application Priority Data

Oct. 16, 1998 (KR) ..... 98-43764

(51) Int. Cl.[7] ..... G10L 21/02; G10L 19/04

(52) U.S. Cl. ..... 704/225; 704/219; 704/228; 381/94.1

(58) Field of Search ..... 704/219, 225, 704/226, 228; 381/94.1

(56) References Cited

U.S. PATENT DOCUMENTS 5,659,622 A * 8/1997 Ashley ..... 381/94.1
5,937,377 A * 8/1999 Hardiman et al. ..... 704/225
6,122,610 A * 9/2000 Isabelle ..... 704/226

OTHER PUBLICATIONS

Tenkasi V. Ramabadran, James P. Ashley, and Michael J. McLaughlin, "Background Noise Suppression for Speech Enhancement and Coding", Proc. 1997 IEEE Workshop on Speech Coding for Telecommunications, p. 43–44, Sep. 1977.*

* cited by examiner

*Primary Examiner*—Tālivaldis Ivars Šmits
(74) *Attorney, Agent, or Firm*—F. Chau & Associates, LLP

(57) ABSTRACT

A decoding method of an Enhanced Variable Rate Codec (EVRC) is provided for reducing EVRC noises during error packet processing in a CDMA system. The method induces setting a seed value for generating background noise when the input error packet is a first error packet, and the seed value is maintained when the error packet is inputted continually. In addition, an average fixed codebook gain and an average eighth gain are decayed, so that the decoder of the EVRC can generate more comfort background noises without loud annoying noises. Further, an excitation signal is post filtered selectively, so that granular noise can be prevented and speech quality of the decoder output is improved.

19 Claims, 8 Drawing Sheets

METHOD FOR ELIMINATING ANNOYING NOISES OF ENHANCED VARIABLE RATE CODEC (EVRC) DURING ERROR PACKET PROCESSING

FIELD OF THE INVENTION

The present invention relates to a method for eliminating noises in code division multiple access (CDMA) systems and, more particularly to a method for eliminating annoying noises of an Enhanced Variable Rate Codec (EVRC) of a CDMA system in a weak electromagnetic field.

BACKGROUND OF THE INVENTION

Vocoders are used in communication devices, such as cellular phones or personal communication services (PCS), to provide digital signal compression of an analog audio signal that is converted into a digital form for transmission purpose. A conventional variable rate vocoder is disclosed in U.S. Pat. No. 5,414,796 issued to Jacobs et al. In this particular implementation of a variable rate vocoder, an input speech is encoded by using Code Excited Linear Predictive (CELP) coding technique at one of several rates as determined by a level of speech activity.

The CDMA Development Group (CDG) and Telecommunication Industry Association (TIA) finalized the specification of a new vocoder called Enhanced Variable Rate Codec (EVRC) for providing better quality than that of an existing vocoder. An EVRC algorithm is specified in TIA/EIA/IS-127, and an EVRC method is proposed in TIA/EIA/IS-718 with a fixed point C code.

The core of the standard EVRC algorithm is a Relaxed Code-Excited Linear Predictive (RCELP) coding. The RCELP coding is a generalization of the CELP speech coding algorithm and is particularly well suited for variable rate operation and robustness in CDMA environment.

FIG. 1 is a block diagram illustrating a conventional mobile station having an EVRC. Referring to FIG. 1, the mobile station comprises a Radio Frequency (RF) transmitter/receiver 10, a baseband analog processor 20, a Mobile Station Modem (MSM) 70, a Digital-to-Analog Converter 80, and an Analog-to-Digital Converter 90. The MSM 70 includes a baseband digital modem 30, a variable vocoder 40 having an encoder 50 and a decoder 60, and a Central Processing Unit (CPU) 70.

FIG. 2 is a block diagram illustrating the encoder of the EVRC shown in FIG. 1. Referring to FIG. 2, the encoder 50 eliminates DC components and noise contained in the input speech signal IN_SPEECH from the A/D converter 90 by using high-pass and adaptive noise suppression filtering. And the encoder 50 determines Linear Prediction Coefficients (LPCs) and a rate. An LPC analysis filter 55 generates an excitation signal EXCITATION in response to the LPC coefficients and the filtered input speech signal IN_SPEECH'. The LPCs are converted to Line Spectral Pairs (LSPs). An adaptive codebook search process and a fixed codebook search process are respectively executed, thereby an adaptive codebook memory 58 is updated. Through above described processes, the input speech signal IN_SPEECH is converted to a digital speech packet that is supplied to the baseband digital modem 30.

FIG. 3 is a block diagram illustrating the decoder of the EVRC shown in FIG. 1. Referring to FIG. 3, the decoder 60 includes an adaptive codebook decoder 61, a fixed codebook decoder 62, an adaptive codebook memory 63, an LPC synthesis filter 64, and an adaptive post filter 67 including a pitch post filter 65 and an LPC synthesis post filter 66. The adaptive codebook decoder 61 decodes adaptive codebook factors acb_gain and acb_delay from the encoder 50 and generates an adaptive codebook excitation signal. Similarly, the fixed codebook decoder 62 decodes fixed codebook factors fcb_gain and fcb_index from the encoder 50 and generates a fixed codebook excitation signal. The adaptive codebook excitation signal and the fixed codebook excitation signal are added for generating a total excitation signal EXCITATION. The excitation signal EXCITATION is used for updating the adaptive codebook memory 63. The LPC synthesis filter 64 generates a synthesized signal OUT_SPEECH' in response to the excitation signal EXCITATION and the LPC coefficients from the encoder 50 which are interpolated. The synthesized signal OUT_SPEECH' is post-filtered through the pitch post filter 65 and the LPC post filter 66 so as to generate an output speech signal OUT_SPEECH. The adaptive post filter 67 improves the perceived speech quality of the decoder output signal OUT_SPEECH.

Additionally, the decoder 60 of the EVRC 40 is used for processing error packets as well as the above described operations. When the decoder 60 receives an error packet, the decoder 60 detects a last valid rate of the error packet inputted and decays a decoded signal by the detected rate. For example, the detected rate is either a full rate or a half rate.

The decoder 60 based on the specifications TIA/EIA/IS-127 and TIA/EIA/IS-718 stores an average adaptive codebook gain avg_acb_gain and an average fixed codebook gain avg_fcb_gain, so as to determine a codebook gain of the inputted error packet. If the stored average adaptive codebook gain avg_acb_gain is greater than a predetermined reference value (for example, 0.2), the excitation signal EXCITATION is post-filtered by the pitch post filter 65 of the adaptive post filter 67, wherein the excitation signal EXCITATION includes the adaptive codebook factors.

If the stored average adaptive codebook gain avg_acb_gain is less than the reference value (for example, 0.2), a seed value for generating background noise is set by a certain LSP coefficient and the background noise is generated to the excitation signal EXCITATION. In that case, the excitation signal EXCITATION includes the sum of the adaptive codebook factors and the fixed codebook factors. The excitation signal EXCITATION is filtered by the adaptive post filter 67 with the pitch post filter 65. More detailed error packet processing routine of the decoder 60 will be described below with reference to FIG. 4, which is a flowchart illustrating a conventional method for processing an error packet of the decoder included in the EVRC and illustrates an algorithm based on the specifications TIA/EIA/IS-127 and TIA/EIA/IS-718 for the EVRC 40.

Referring to FIG. 4, at step S110, an error packet is inputted to the decoder 60 of the EVRC 40. A last valid rate of the input packet is determined at step S112. If the determined valid rate is either 'full' or 'half', it is asked at step S114 whether the error packet is occurring continually. If so, an average adaptive codebook gain avg_acb_gain is reduced to 75% at step S116, and then an excitation signal EXCITATION is generated from the calculated average adaptive codebook gain avg_acb_gain at step S118. The magnitude of the excitation signal EXCITATION is reduced to 75% because of the reduced average adaptive codebook gain avg_acb_gain.

If the error packet is determined not to occur continually at step 114, the flow continues to step S118 wherein the excitation signal EXCITATION is generated without the reduction. At step S120, it is determined whether the average adaptive codebook gain avg_acb_gain is less than a predetermined reference value of 0.2. If so, at step S122, the seed value is set and the background noise is generated to the excitation signal EXCITATION. If not, the background noise is not generated. At step S124, the excitation signal EXCITATION is post-filtered through the pitch post filter 65 and the LPC post filter 66, so as to improve the perceived speech quality of the output speech signal. At step S126, the final output speech signal is doubled to be outputted from the decoder 60 and the error packet processing routine of the decoder 60 of the EVRC 40 is ended.

At step S112, if the error packet has the last valid rate of an eighth, the control flow proceeds to step S128 wherein the background noise is produced in response to a seed value, and an excitation signal EXCITATION is generated by an average eighth gain and the generated background noise, wherein the seed value in the eighth rate is set at the beginning of the decoder. At step S130, the excitation signal EXCITATION is filtered through the LPC post filter 66 without the pitch post filter 65. At step S132, the final output speech signal is outputted without amplification, and the error packet processing routine of the decoder 60 of the EVRC 40 is ended.

Otherwise, above described error packet processing routine of the decoder 60 based on the TIA/EIA/IS-718 specification has the problem that the decoder 60 of the EVRC 40 generates annoying noise in a weak electromagnetic field, which inputs a large number of error packets to the decoder 60.

As is shown in step S122 of FIG. 4, at the full rate and the half rate, the seed value for generating the background noise is set to the same number in every subframe of the error packet while the error packet is inputted continually. Thus, the annoying noise is generated periodically in every subframe of the error packet by the periodical seed value. When the stored average fixed codebook gain avg_fcb_gain is great, a loud annoying noise is maintained continually before inputting a valid frame, because the average fixed codebook gain avg_fcb_gain is not decayed by the specifications TIA/EIA/IS-127 and TIA/EIA/IS-718.

Additionally, in the error packet processing routine with the eighth rate according to the specifications TIA/EIA/IS-127 and TIA/EIA/IS-718, the decoder 60 of the EVRC 40 uses the average eighth gain for determining the gain of the background noise by storing the average eighth gain of the last valid frame. As described above, the average eighth gain is not decayed by the specifications TIA/EIA/IS-127 and TIA/EIA/IS-718, so that the loud annoying noise is maintained continually before inputting a valid frame when the stored average eighth gain is great.

Generally, the level of the post-filtered signal goes down under certain level (i.e., about 50%), when the excitation signal is post-filtered by the pitch post filter 65. During the post-filtering the post-filtered signal is quantized, so that the data loss is occurred. The quantized post-filtered signal is compensated by amplification, as shown in the step S126 of FIG. 4. In this case, output speech signal of the decoder 60 is affected by granular noise because of the amplified quantized signal.

SUMMARY OF THE INVENTION

It is an object of the present invention to provide a method for eliminating periodically generated annoying noises of an Enhanced Variable Rate Codec (EVRC) in a weak electromagnetic field.

It is another object of the present invention to provide a method for generating more comfortable background noises in EVRC.

In order to attain the above objects as well as other objects, according to an aspect of the present invention, there is provided a method for eliminating annoying noise during an error packet processing of an enhanced variable rate vocoder having adaptive codebook factors and fixed codebook factors, the method comprising the steps of: detecting a last valid rate when an error packet is inputter; decaying an average fixed codebook gain to a first threshold when the detected rate is a full rate or a half rate; fading an excitation signal in response to an average adaptive codebook gain and the adaptive codebook factors; generating background noise to the excitation signal in response to the average fixed gain and a seed value; filtering the excitation signal by an adaptive post filter having a pitch post filter and a linear prediction coefficient (LPC) post filter; and outputting the filtered signal. The seed value is set only once at a first error packet for each error packet processing, although the error packet is inputted continually.

BRIEF DESCRIPTION OF THE DRAWINGS

The present invention will be described by way of exemplary embodiments, but not limitations, illustrated in the accompanying drawings in which like references denote similar elements, and in which.

DESCRIPTION OF PREFERRED EMBODIMENTS

Figure 1:
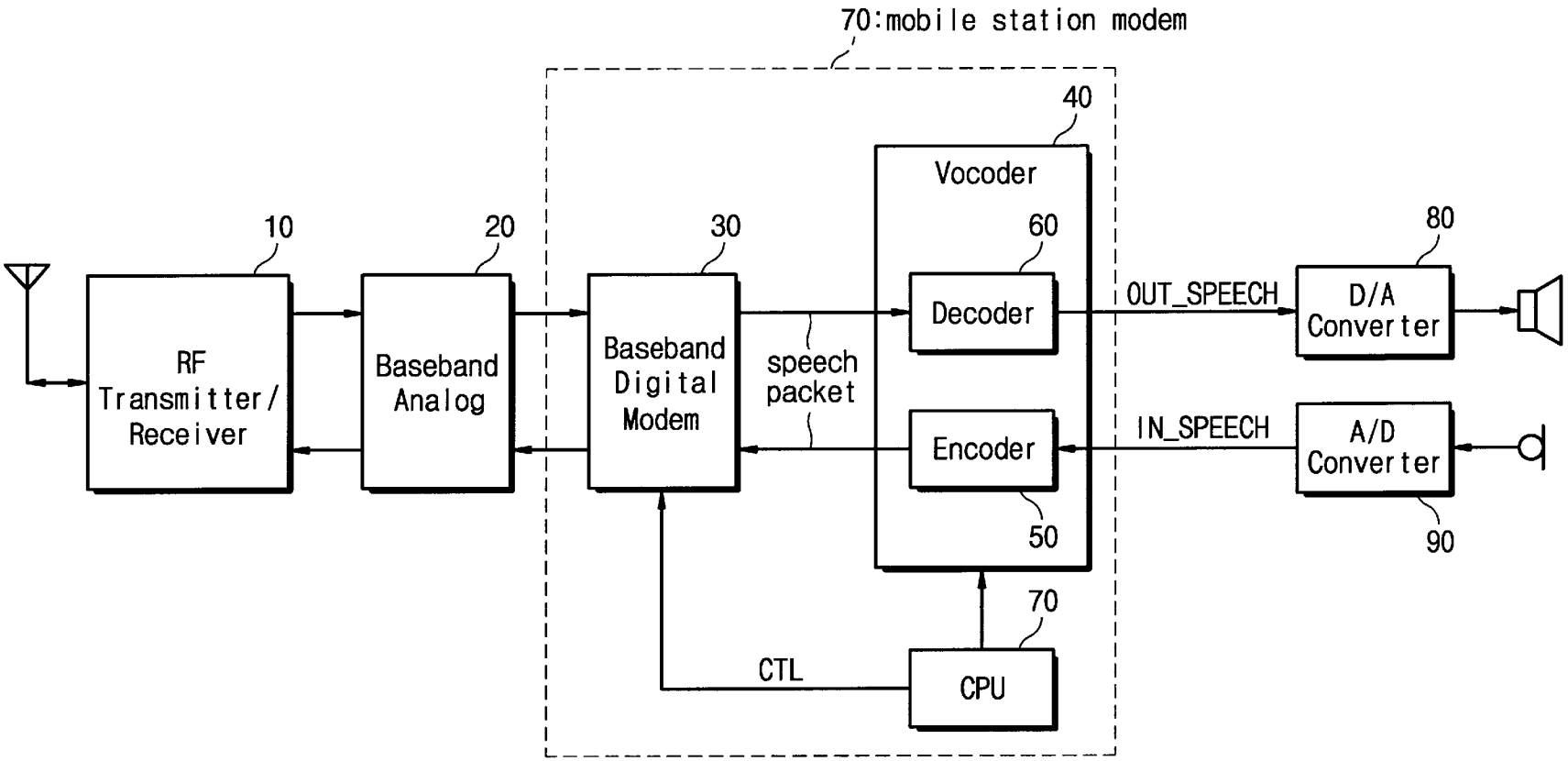
Fig. 1 (Prior Art)
FIG. 1 is a block diagram illustrating a conventional mobile station having an EVRC.
Figure 2:
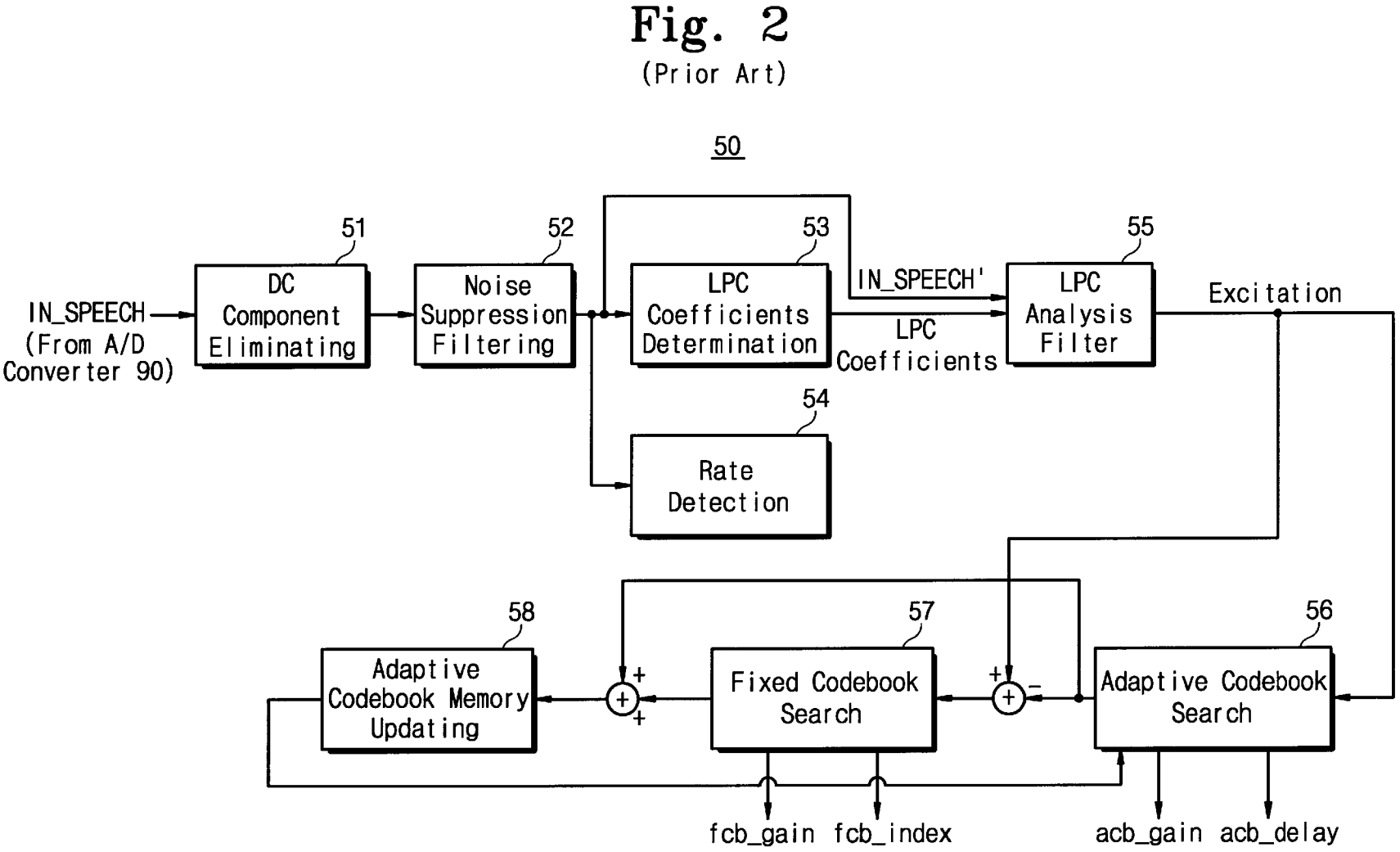
Fig. 2 (Prior Art)
FIG. 2 is a block diagram illustrating an encoder of the EVRC shown in FIG. 1.
Figure 3:
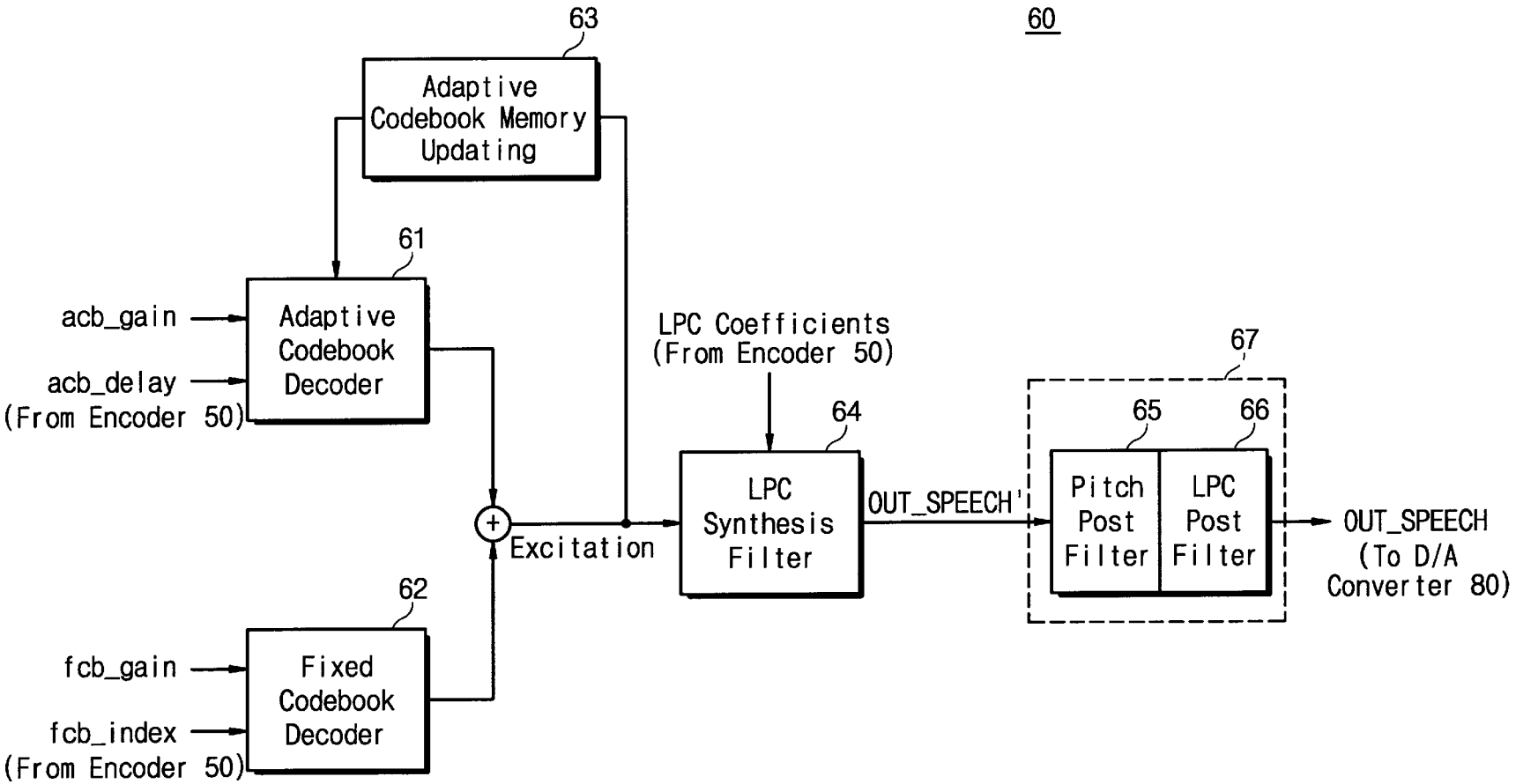
Fig. 3 (Prior Art)
FIG. 3 is a block diagram illustrating a decoder of the EVRC shown in FIG. 1.
Figure 4:
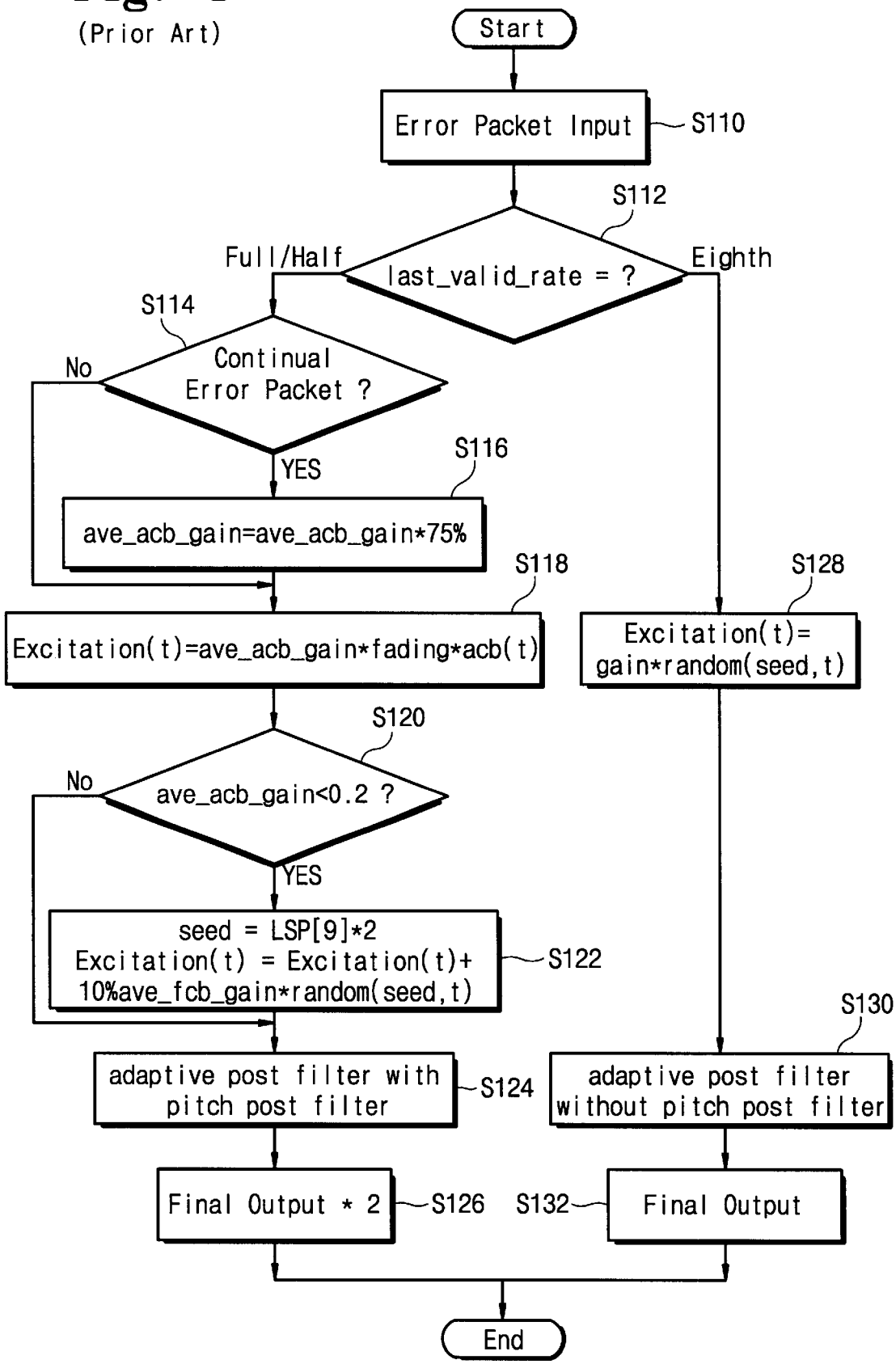
Fig. 4 (Prior Art)
FIG. 4 is a flowchart illustrating a conventional method for an error packet processing routine of a decoder included in an EVRC.
Figure 5A:
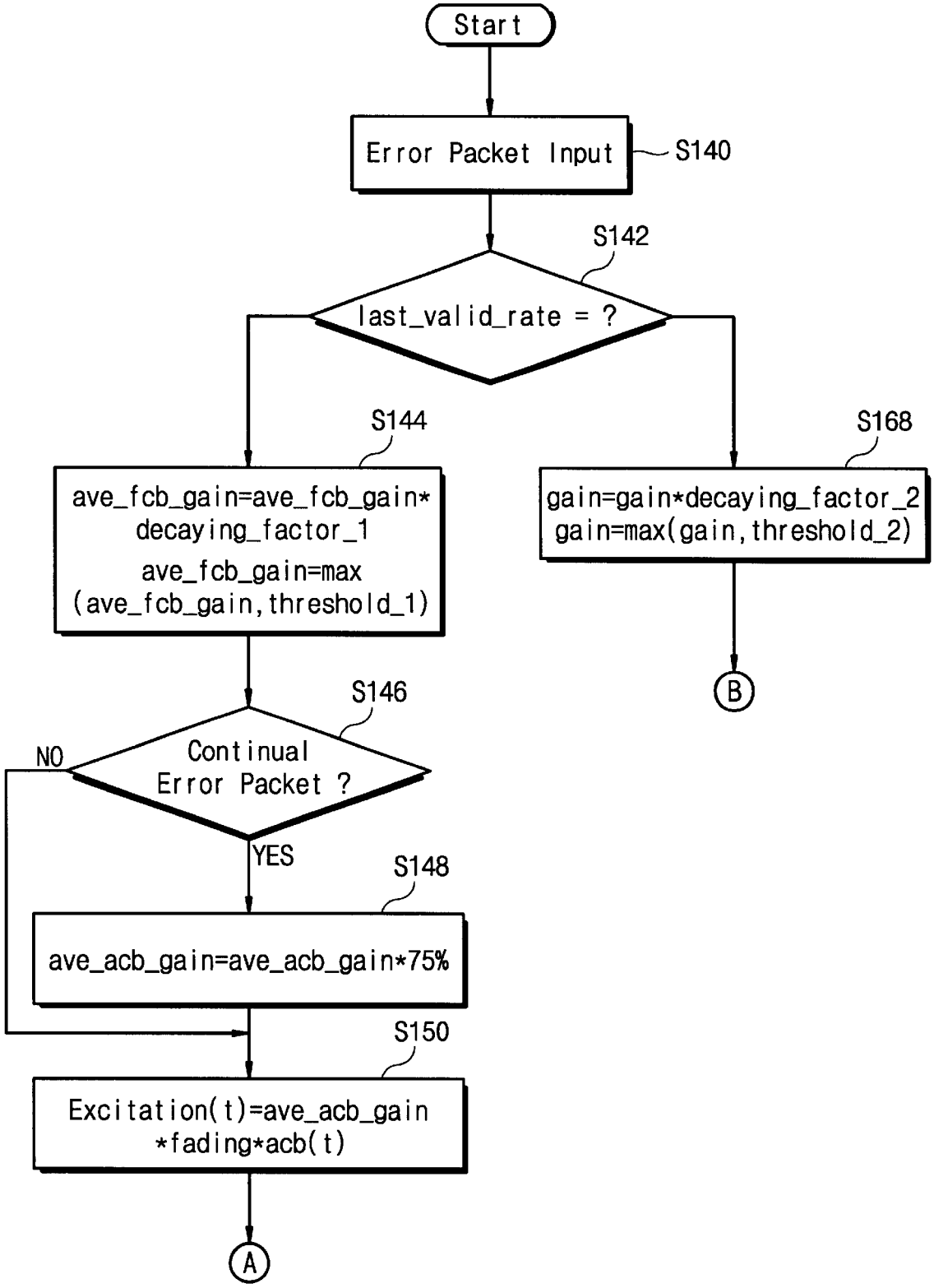
FIGS. 5A and 5B are flowcharts illustrating a method for eliminating annoying noise during an error packet processing of a decoder included in an EVRC according to the present invention.
Figure 5B:
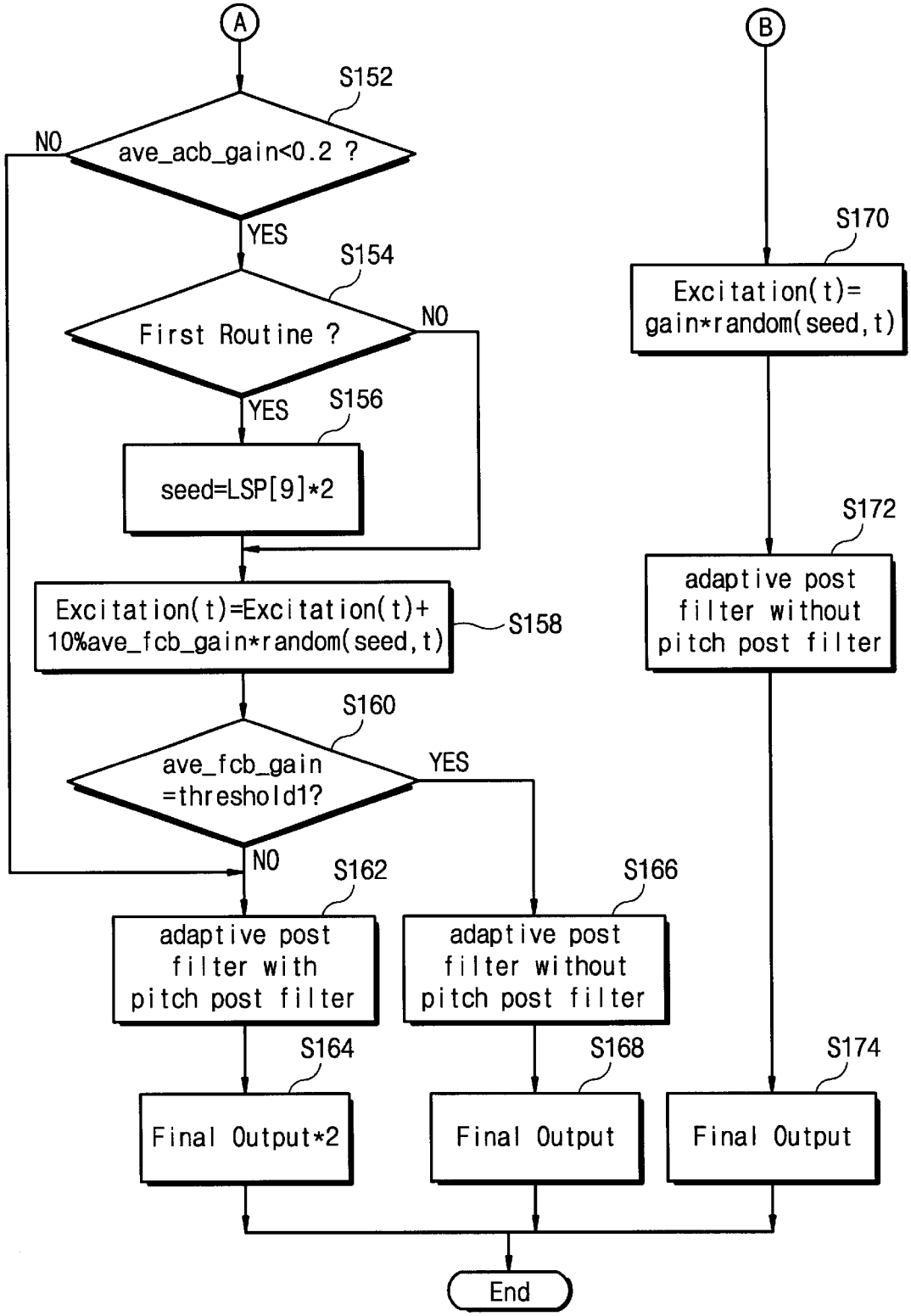

FIGS. 5A and 5B are flowcharts illustrating a method for eliminating annoying noises during error packet processing of a decoder included in an EVRC according to the present invention.

Referring to FIG. 5A, at step S140, an error packet is inputted to the decoder of the EVRC. At step S142, a last valid rate of the input packet is determined. If the determined valid rate is either a full rate or a half rate, control flow proceeds to step S144 wherein, an average fixed codebook gain avg_fcb_gain is decayed to a first threshold, and the average fixed codebook gain avg_fcb_gain is reset by selecting a maximum value either the decayed average fixed codebook gain avg_fcb_gain or the first threshold. This is different from the specifications TIA/EIA/IS-127 and TIA/EIA/IS-718. Thus, although the average fixed codebook gain avg_fcb_gain is high, the decoder of the EVRC can generate background noises without the loud and annoying noises in the full and the half rate.

At step S146, it is determined whether the error packet is inputted continually to the decoder. Generally, in a weak electromagnetic field, the error packet is inputted continually. If so, the flow proceeds to step S148 wherein an average adaptive codebook gain avg_acb_gain is reduced to 75%, then to step S150 wherein an excitation signal EXCITATION is faded in response to the reduced average adaptive codebook gain avg_acb_gain. If not, the flow proceeds to step S150 wherein the excitation signal EXCITATION is faded in response to the average adaptive codebook gain avg_acb_gain and adaptive codebook factors.

Referring to FIG. 5B, at step S152, it is determined whether the average adaptive codebook gain avg_acb_gain is less than a predetermined reference value (for example, 0.2). When the average adaptive codebook gain avg_acb_gain is less than the predetermined reference value, the background noise is generated. Thus, if so, it is determined at step S154 whether the average codebook gain avg_acb_gain is less than the reference value for the first time after commencing the input of the error packet. In other words, at the step S154, it is determined whether the routine of the step S154 is the first routine after the commencement of the error packet input. If so, a seed value is set by a certain linear spectrum pair (LSP) coefficient. The seed value is used for generating random noise as the background noise. At step S158, a background noise is generated to the excitation signal EXCITATION in response to the seed value.

As described above, the seed value is set only once during the error packet processing, and the seed value is not updated although the error packet is inputted continually. Thus, the periodically generated annoying noise can be eliminated.

At step S160, it is determined whether the average fixed codebook gain avg_fcb_gain is equal to a first threshold. If so, the control flow continues to step S166, wherein the excitation signal EXCITATION is post-filtered by an Linear Prediction Coefficient (LPC) post filter of an adaptive post filter without a pitch post filter, and the post-filtered signal is outputted in step S168. If not, the flow continues to step S162, wherein the excitation signal EXCITATION is post-filtered by the pitch post filter and the LPC post filter of the adaptive post filter. At step S164, the post-filtered signal is compensated by amplification before being outputted, since the magnitude of the post-filtered signal is reduced by the pitch post filter.

At step S152, if the average adaptive codebook gain avg_acb_gain is not less than the reference value (for example, 0.2), the control flow proceeds to the step S162 for post-filtering the excitation signal EXCITATION through the pitch post filter and the LPC post filter. The post-filtered signal is compensated by the amplification and outputted in the step S164.

As described above, according to the present invention, the pitch post filter of the adaptive post filter is enabled or disabled for the selective post-filtering to prevent granular noise. Thus, the perceived speech quality of the decoder output can be improved.

Referring to FIGS. 5A and 5B again, at step S142, if the last valid rate of the error packet is at the rate of an eighth, the control flow proceeds to step S168 wherein an average eighth gain is decayed to a second threshold, and the average eighth gain is reset to a maximum value by selecting either the gain or the second threshold. At step S170, the background noise is generated in response to a seed vale, and the excitation signal EXCITATION is generated by the average eighth gain and the generated background noise, wherein the seed value in the eighth rate is set at a beginning of the decoder. At step S172, the excitation signal EXCITATION is post-filtered by the LPC post filter of the adaptive post filter without the pitch post filter, and the post-filtered signal is outputted in step S174.

As described above, the average eighth gain is decayed in the error packet processing at the rate of an eighth. Thus, although the stored average eighth gain is great, the decoder of the EVRC can generate more comfort background noise without loud annoying noise at the rate of an eighth.

Figure 6A:
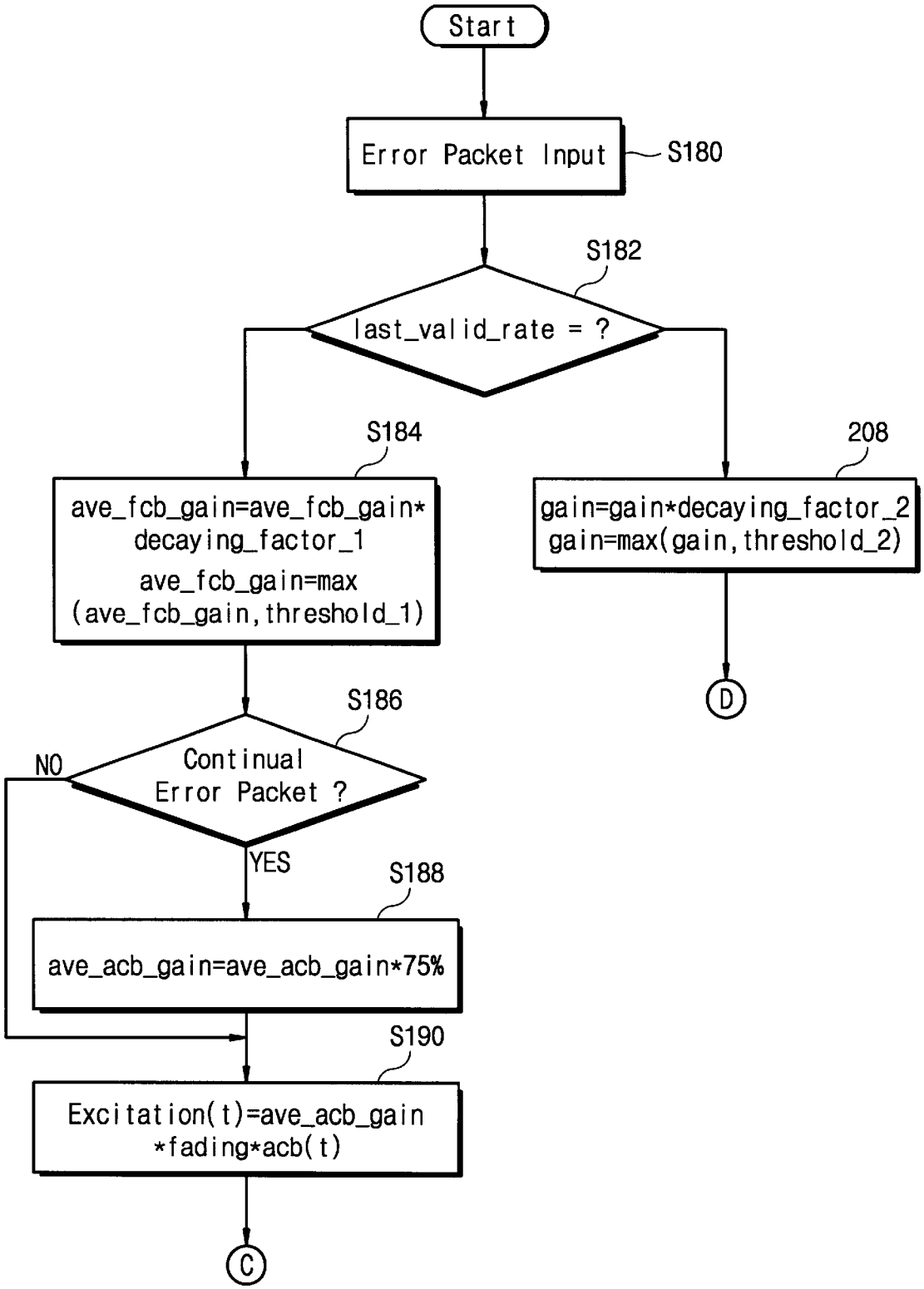
FIGS. 6A and 6B are flowcharts illustrating another method of eliminating annoying noise during an error packet processing of a decoder included in an EVRC according to the present invention.
Figure 6B:
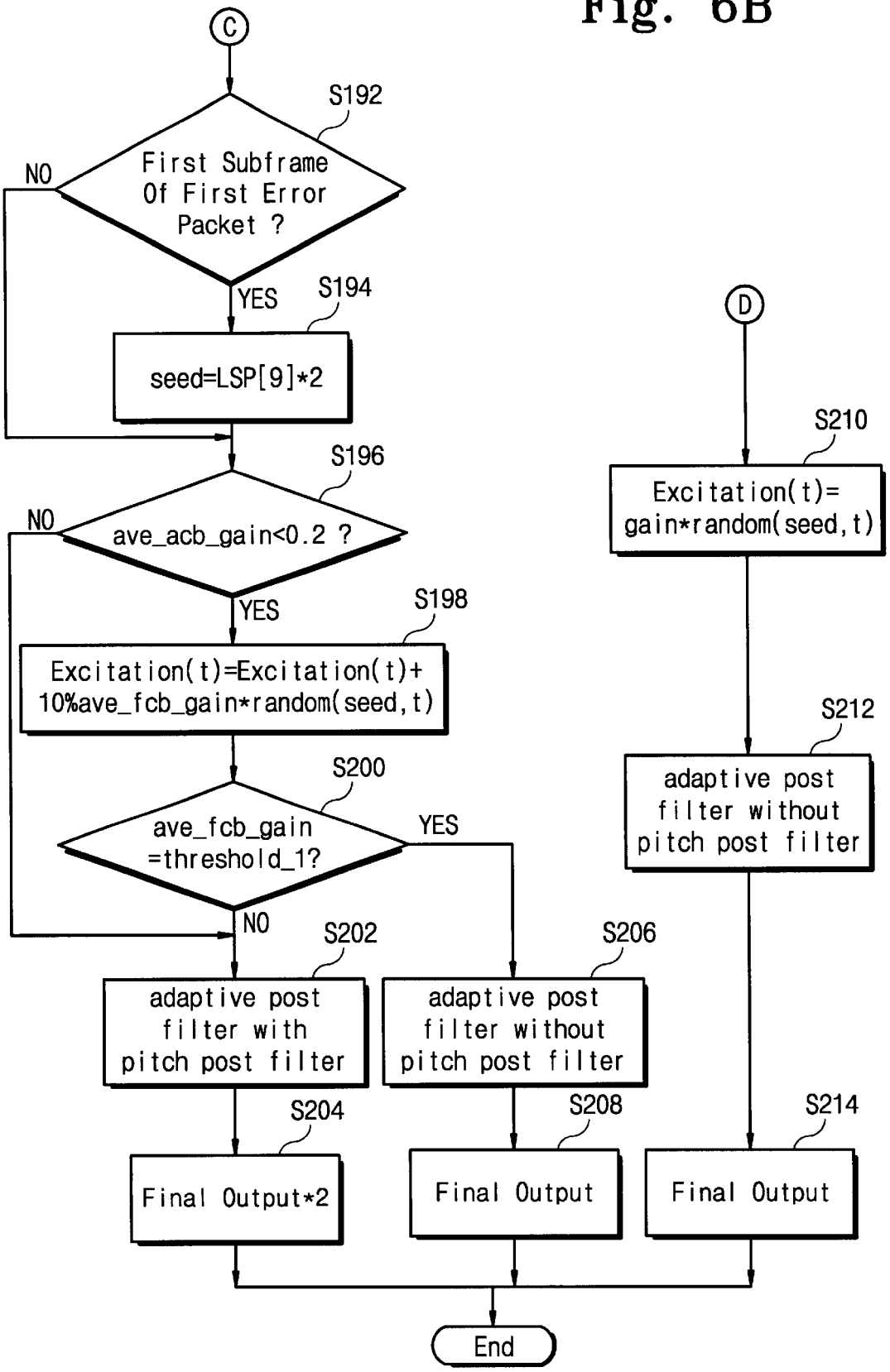

FIGS. 6A and 6B are flowcharts illustrating another method for eliminating annoying noise during an error packet processing of a decoder included in an EVRC according to the present invention.

Referring to FIG. 6A, at step S180, an error packet is inputted to the decoder of the EVRC. At step S182, a last valid rate of the input packet is determined. If the determined valid rate is either a full rate or a half rate, control flow proceeds to step S184 wherein an average fixed codebook gain avg_fcb_gain is decayed to a first threshold, and the average fixed codebook gain avg_fcb_gain is reset by selecting a maximum value either the decayed average fixed codebook gain avg_fcb_gain or the first threshold. Thus, although the stored average fixed codebook gain avg_fcb_gain is great, the decoder of the EVRC can generate more comfort background noise without loud annoying noise in the full and the half rate.

At step S186, it is determined whether the error packet is inputted continually to the decoder. If so, the flow proceeds to step S188 wherein an average adaptive codebook gain avg_acb_gain is reduced to 75%, then to step S190 wherein an excitation signal EXCITATION is faded in response to the reduced average adaptive codebook gain avg_acb_gain. If not, the flow proceeds to step S190 wherein the excitation signal EXCITATION is faded in response to the average adaptive codebook gain avg_acb_gain and adaptive codebook factors.

Referring to FIG. 6B, at step S192, it is determined whether this frame is a first subframe of a first error packet. If so, a seed value for generating a background noise is set to a certain LSP coefficient. If not, the seed value is not set. At step S196, it is determined whether the average codebook gain avg_acb_gain is less than a predetermined reference value (for example, 0.2). If so, at step S198 the background noise is generated to the excitation signal EXCITATION in response to the seed value. In that case, the periodically generated annoying noise can be eliminated, since the seed value is set when the input error packet is the first subframe of the first error packet, and is not updated although the error packet is inputted continually.

At step S200, it is determined whether the average fixed codebook gain avg_fcb_gain is equal to a first threshold. If so, the control flow continues to step S206, wherein the excitation signal EXCITATION is post-filtered by an LPC post filter of an adaptive post filter without a pitch post filter, and the post-filtered signal is outputted in step S208. If not, the flow continues to step S202, wherein the excitation signal EXCITATION is post-filtered by the pitch post filter and the LPC post filter of the adaptive post filter. At step S204, the post-filtered signal is compensated by amplification before being outputted, since the level of the post-filtered signal is reduced to about 50% by the pitch post filter.

At step S196, if the average adaptive codebook gain avg_acb_gain is not less than the reference value, the control flow proceeds to the step S202 for post-filtering the excitation signal EXCITATION through the pitch post filter and the LPC post filter.

Referring to FIGS. 6A and 6B again, at step S182, if the last valid rate of the error jacket is at the rate of an eighth, the control flow proceeds to step S208 wherein an average eighth gain is decayed to a second threshold, and the average eighth gain is reset to a maximum value by selecting either the gain or the second threshold. At step S210, the background noise is generated in response to a seed vale, and the excitation signal EXCITATION is generated by the gain and the background noise, wherein the seed value in the eighth rate is set at the beginning of the decoder. Since the average eighth gain is decayed, the decoder of the EVRC can generate more comfort background noise without loud annoying noise at the rate of an eighth, although the stored average eighth gain is great. At step S212, the excitation signal EXCITATION is post-filtered by the LPC post filter of the adaptive post filter without the pitch post filter, and the post-filtered signal is outputted in step S214.

As described above, according to the present invention, the seed value for generating the background noise is set when the input error packet is the first subframe of the first error packet, and the seed value is not updated although the error packet is inputted continually. Thus, the periodically generated annoying noise can be eliminated.

In addition, the average fixed codebook gain avg_fcb_gain and the average eighth gain are decayed. Thus, although the stored average fixed codebook gain avg_fcb_gain and the average eighth gain have great values, the decoder of the EVRC can generate more comfort background noise without loud annoying noise at the rate of a full, a half, and an eighth.

Further, the excitation signal is post-filtered selectively, so that granular noise can be prevented. Thus, the perceived speech quality of the decoder output can be improved by preventing the granular noise.

While the invention has been described in terms of an exemplary embodiment, it is contemplated that it may be practiced as outlined above with modifications within the spirit and scope of the appended claims.

What is claimed is:

1. A method for reducing annoying noises of an enhanced variable rate vocoder having adaptive codebook factors and fixed codebook factors, the method comprising the steps of:

detecting a last valid rate of an inputted error packet;

decaying an average fixed codebook gain to a first threshold when the last valid rate detected is a full rate or a half rate;

fading an excitation signal in response to an average adaptive codebook gain and the adaptive codebook factors;

generating background noises associated with the excitation signal in response to the average fixed codebook gain and a seed value when the average adaptive codebook gain is less than a predetermined reference value;

filtering the excitation signal by an adaptive post filter having a pitch post filter and a linear prediction coefficient (LPC) post filter; and outputting the filtered signal.

2. The method of claim 1, further comprising the steps of:

decaying an average eighth gain to a second threshold when the last valid rate detected is an eighth rate;

generating an excitation signal in response to the average eighth gain and a seed value set at beginning of the decoder;

filtering the excitation signal through the adaptive post filter without the pitch post filter; and outputting the filtered signal.

3. The method of claim 2, wherein the step of decaying includes the step of resetting the average eighth gain by selecting a larger value from the decayed average eighth gain and the second threshold.

4. The method of claim 1, further comprising the step of reducing the average adaptive codebook gain to a predetermined level when the error packet is inputted continually, wherein the reduced average adaptive codebook gain is used for fading the excitation signal.

5. The method of claim 4, wherein the predetermined level is substantially equal to an amount of 75% of the average adaptive codebook gain.

6. The method of claim 1, wherein the seed value is set once for each error packet processing.

7. The method of claim 1, wherein the filtering step includes the step of filtering the excitation signal through the linear prediction coefficient (LPC) post filter without the pitch post filter when the average fixed codebook gain is equal to the first threshold.

8. The method of claim 1, wherein the filtering step includes the steps of:

filtering the excitation signal through the pitch post filter and the linear prediction coefficient (LPC) post filter when the average fixed codebook gain is not equal to the first threshold; and compensating the filtered signal by amplifying the filtered signal.

9. The method of claim 1, wherein the step of decaying includes the step of resetting the average fixed codebook gain by selecting a larger value from the decayed average fixed codebook gain and the first threshold.

10. The method of claim 1, wherein the predetermined reference value is substantially equal to "0.2".

11. The method of claim 1, wherein the step of generating a background noise includes the step of setting the seed value with a predetermined linear spectrum pair (LSP) coefficient, when the average adaptive codebook gain is less the predetermined reference value for the first time after commencing the error packet processing.

12. A method for eliminating annoying noise of an enhanced variable rate vocoder having adaptive codebook factors and fixed codebook factors, the method comprising the steps of:

detecting a last valid rate of an error packet inputted;

decaying an average fixed codebook gain to a first threshold when the last valid rate detected is a full rate or a half rate;

fading an excitation signal in response to an average adaptive codebook gain and the adaptive codebook factors;

determining whether the average adaptive codebook gain is less than a predetermined reference value for the first time after commencing the input of the error packet;

setting a seed value used for generating a background noise and decaying the excitation signal, when the average adaptive codebook gain is less than the reference value for the first time after commencing the input of the error packet, wherein the background noise is generated to the excitation signal in response to the seed value and the average fixed codebook gain;

determining whether the average fixed codebook gain is equal to the first threshold;

filtering the excitation signal through an adaptive post filter without a pitch post filter, when the average fixed codebook gain is equal to the first threshold; and outputting the filtered signal.

13. The method according to claim 12, further comprising the steps of:

decaying an average eighth gain to a second threshold when the last valid rate detected is an eighth rate;

generating an excitation signal in response to the average eighth gain and a seed value set at beginning of the decoder;

filtering the excitation signal through the adaptive post filter without the pitch post filter; and outputting the filtered signal.

14. The method of claim 12, further comprising the step of filtering the excitation signal faded at the step of fading through the adaptive post filter with the pitch post filter, when the average fixed codebook gain is not equal to the first threshold.

15. The method of claim 12, further including the step of reducing the average adaptive codebook gain to a predetermined level when the error packet is inputted continually, wherein the reduced average adaptive codebook gain is used for fading the excitation signal.

16. The method of claim 12, further comprising the step of filtering the excitation signal faded at the step of fading through the adaptive post filter with the pitch post filter, when the average adaptive codebook gain is equal to or greater than the reference value.

17. A method for eliminating annoying noise of an enhanced variable rate vocoder having adaptive codebook factors and fixed codebook factors, the method comprising the steps of:

detecting a last valid rate of an error packet inputted;

decaying an average fixed codebook gain to a first threshold when the last valid rate detected is a full rate or a half rate;

fading an excitation signal in response to an average adaptive codebook gain and the adaptive codebook factors;

determining whether the error packet detected is a first subframe of a first error packet;

setting a seed value, when the error packet detected is the first subframe of the first error packet;

determining whether the average adaptive codebook gain is less than a predetermined reference value;

generating a background noise to the excitation signal in response to the seed value and the average fixed codebook gain, when the average adaptive codebook gain is less than the predetermined reference value;

determining whether the average fixed codebook gain is equal to the first threshold;

filtering the excitation signal through an adaptive post filter without a pitch post filter when the average fixed codebook gain is equal to the first threshold, while filtering the excitation signal through the adaptive post filter with the pitch post filter when the average fixed codebook gain is not equal to the first threshold; and outputting the filtered signal.

18. The method according to claim 17, further comprising the steps of:

decaying an average eighth gain to a second threshold when the last valid rate detected is an eighth rate;

generating an excitation signal in response to the average eighth gain and a seed value set at beginning of the decoder;

filtering the excitation signal through the adaptive post filter without the pitch post filter; and outputting the filtered signal.

19. The method of claim 17, further comprising the step of filtering the excitation signal faded at the step of fading through the adaptive post filter with the pitch post filter, when the average adaptive codebook gain is equal to or greater than the reference value.

* * * * *